US006330413B1

(12) United States Patent
Yamamoto et al.

(10) Patent No.: US 6,330,413 B1
(45) Date of Patent: Dec. 11, 2001

(54) IMAGE FORMING APPARATUS HAVING AN LED CHARGE ERASING DEVICE

(75) Inventors: Akira Yamamoto, Tokyo; Atsushi Hosoi, Moriya-machi; Hiroya Hirose, Sagamihara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/441,513

(22) Filed: Nov. 17, 1999

(30) Foreign Application Priority Data

Nov. 24, 1998 (JP) ..... 10-349390
Apr. 2, 1999 (JP) ..... 11-095960

(51) Int. Cl.[7] ..... G03G 15/04
(52) U.S. Cl. ..... 399/186
(58) Field of Search ..... 399/128, 296, 399/186–188

(56) References Cited

U.S. PATENT DOCUMENTS 4,576,464 * 3/1986 Sakata et al. ..... 399/186
4,728,982 * 3/1988 Takemura ..... 399/186
4,884,107 * 11/1989 Watanabe ..... 399/186 X
5,030,992 * 7/1991 Yoneda et al. ..... 399/186

* cited by examiner

*Primary Examiner*—William J. Royer
(74) *Attorney, Agent, or Firm*—Fitzpatrick, Cella, Harper & Scinto

(57) ABSTRACT

An image forming apparatus includes a photosensitive member drum, a charging device for charging the photosensitive member drum, an image exposure device for image-exposing the photosensitive member drum, and an electric charge erasing device for erasing an electric charge outside an image-exposing area of the photosensitive member drum, wherein the electric charge erasing device is provided with a light emitting element and an optical element for lowering an amount of light which is incident on a border between the image-exposing area and an outside area thereof from the light emitting element.

8 Claims, 8 Drawing Sheets

IMAGE FORMING APPARATUS HAVING AN LED CHARGE ERASING DEVICE

BACKGROUND OF THE INVENTION

1. Field of the Invention

The present invention relates to an image forming apparatus, such as a copying machine, using electrophotographic technique, and more particularly to an image forming apparatus having the function of erasing a charge on a non-image-exposing area of a photosensitive member to prevent a developing agent from adhering to the non-image-exposing area.

2. Description of Related Art

Conventional image forming apparatuses, such as a copying machine or a printer, using electrophotographic technique each are provided with such an image forming means as that shown in FIG. 7. Referring to FIG. 7, a photosensitive member 101 such as an organic photosensitive member is disposed adjacent to a conveying path H through which a sheet member S serving as a transfer member on which to form an image is conveyed (in FIG. 7, conveying rollers, etc., for conveying the sheet member S are omitted from illustration), so that the surface of the sheet member S being conveyed can be brought into close contact with the photosensitive member 101.

The photosensitive member 101 is charged uniformly to positive polarity or negative polarity by a charger 102, such as a corotron charger, a roller charger or the like. After that, an image exposure 103 is performed by an exposure means (not shown) to form an electrostatic latent image on the photosensitive member 101.

The electrostatic latent image is developed by a developing means 104 with a toner opposite in polarity to the electrostatic latent image, thereby becoming a toner image. Then, the toner image is transferred to the sheet member S (transfer member), such as paper, by supplying to the sheet member S a charge opposite in polarity to the toner.

The sheet member S having the toner image transferred thereto is then caused to pass through a fixing device 106, at which the toner image is heated and pressed to be fixed on the sheet member S.

On the other hand, any remaining part of toner which has been left on the photosensitive member 101 without being transferred is removed from the photosensitive member 101 by a cleaning means 107. Then, any residual charge on the photosensitive member 101, which has been cleaned, is removed by a pre-exposure lamp 108 or the like. After that, the photosensitive member 101 is again charged uniformly by the charger 102, so that an image forming cycle as described above is repeated.

Here, an area other than the image-exposing area of the photosensitive member 101 has a charge by the charger 102 remaining there and is, therefore, subjected to developing. Therefore, if the image-exposing area and the position and image-forming area of the sheet member S do not coincide with each other entirely, there is a possibility that a frame-like toner image is formed on a marginal part of the sheet member S .

In addition, in a case where reduction copying is performed or in a case where facing pages of a book or the like are copied, there is also a possibility that an unnecessary frame-like toner image is formed.

Such an unnecessary frame-like toner image not only lowers the image quality but also causes an increase in the amount of consumption of toner, scattering of toner, or the like. In particular, in a case where the frame-like toner image results in an image formed on the fore end of the sheet member S, there is a possibility that the sheet member S is wound onto the fixing roller and becomes difficult to separate from the fixing roller.

Therefore, in a conventional arrangement, in order to erase the above unnecessary frame-like image, there is provided an exposure means 109 for exposing a particular area (outside the image-exposing area) of the photosensitive member 101 (hereinafter, an exposure by the exposure means 109 being referred to as "frame-erasing exposure").

A fuse lamp or an LED (light-emitting diode) is used as a light source of the conventional exposure means 109 for performing the frame-erasing exposure. However, the fuse lamp has a large amount of he at generation, causing a large increase in temperature of the image forming apparatus body, so that the fuse lamp is not appropriate in a case where the image forming apparatus is arranged in a small size.

The LED has an amount of light emission gradually decreased due to the long-term usage thereof. Therefore, the initial amount of light emission of the LED is required to be set large. In this case, since the potential of an area of the photosensitive member 101 which is illuminated by the LED (frame-erasing exposing area) is lowered remarkably with respect to the potential of an area of the photosensitive member 101 which corresponds to the original (image-exposing area), such a potential difference as that shown in FIG. 8 occurs across the position of the end of the original. Therefore, there is a possibility that there occurs a phenomenon in which the frame-erasing exposing area is subjected to developing by the toner of the opposite polarity included in the developing agent (hereinafter, this phenomenon being referred to as "frame fogging").

In particular, in a case where the density of the background of the original is high (for example, newspaper), the above potential difference becomes more conspicuously large.

In the state in which the above potential difference is large, even if a developing electrode is used for developing, there is a possibility that, due to the peripheral electric-field effect, there occurs a phenomenon in which developing-agent particles are caused to adhere to a border part between the frame-erasing exposing area and the image-exposing area by a strong voltage contrast at the border part (hereinafter, this phenomenon being referred to as "border fogging").

BRIEF SUMMARY OF THE INVENTION

The invention has been made in view of the above problem, and an object of the invention is to provide an image forming apparatus capable of preventing unnecessary toner from adhering to a sheet member.

Another object of the invention is to provide an image forming apparatus capable of preventing unnecessary toner from adhering to an area outside an image-exposing area of a photosensitive member.

To attain the above objects, in accordance with an aspect of the invention, there is provided an image forming apparatus, comprising a photosensitive member, a charging means for charging the photosensitive member, an image exposure means for image-exposing the photosensitive member, and an electric charge erasing means for erasing an electric charge outside an image-exposing area of the photosensitive member, wherein the electric charge erasing means includes a light emitting element and an amount-of-light restricting member for lowering an amount of light which is incident on a border between the image-exposing area and an outside area thereof from the light emitting element.

The above and further objects and features of the invention will become apparent from the following detailed description of preferred embodiments thereof taken in conjunction with the accompanying drawings.

DETAILED DESCRIPTION OF THE INVENTION

Hereinafter, preferred embodiments of the invention will be described in detail with reference to the drawings.

(First Embodiment)

Figure 1:
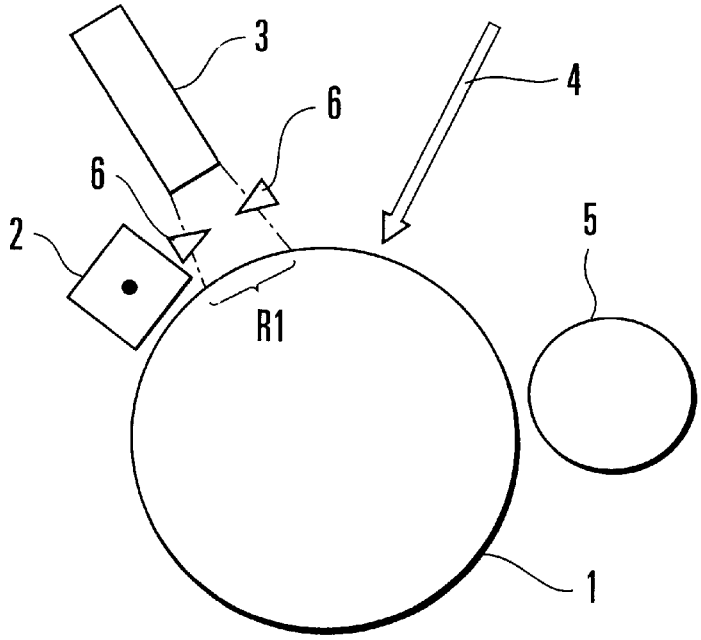
FIG. 1 is a schematic sectional view for explaining the arrangement of essential parts of an image forming apparatus according to a first embodiment of the invention.

FIG. 1 is a schematic sectional view for explaining the arrangement of essential parts of an image forming apparatus according to a first embodiment of the invention. In FIG. 1, reference numeral 1 denotes a photosensitive member drum for bearing an electrostatic latent image thereon. The photosensitive member drum 1 is formed by providing a photoconductive layer made of an organic photosensitive material, α-Si (amorphous silicon), Se (selenium) or the like on a conductive base member made of Al, Fe or the like.

Reference numeral 2 denotes a charger serving as a charging means for uniformly charging the photosensitive member drum 1 to the predetermined polarity and potential. As the charger 2, a known corona charger, a roller charger or the like is used.

Reference numeral 3 denotes an LED array, serving as an electric charge erasing means, for exposing a particular area of the photosensitive member drum 1. The LED array 3 is driven by a driving circuit (not shown) to be turned on and off in such a way as to erase an electric charge on that area outside the image-exposing area which is to be set to the dark potential. Further, the LED array 3 is composed of a plurality of LEDs which are aligned along the longitudinal direction of the photosensitive member drum 1, and an LED or LEDs which become located correspondingly with the area outside the image-exposing area are selected by the driving circuit to make light emission.

Reference numeral 4 denotes an image exposure conducted by an image exposure means (not shown). The image exposure 4 is performed adaptively by an analog exposure using reflected light from the surface of the original or by a digital exposure using laser scanning or LEDs.

Reference numeral 5 denotes a developing sleeve included in a developing means. In the first embodiment, a non-contact developing method in which the developing sleeve 5 does not come into direct contact with the photosensitive member drum 1 is employed.

Figure 7:
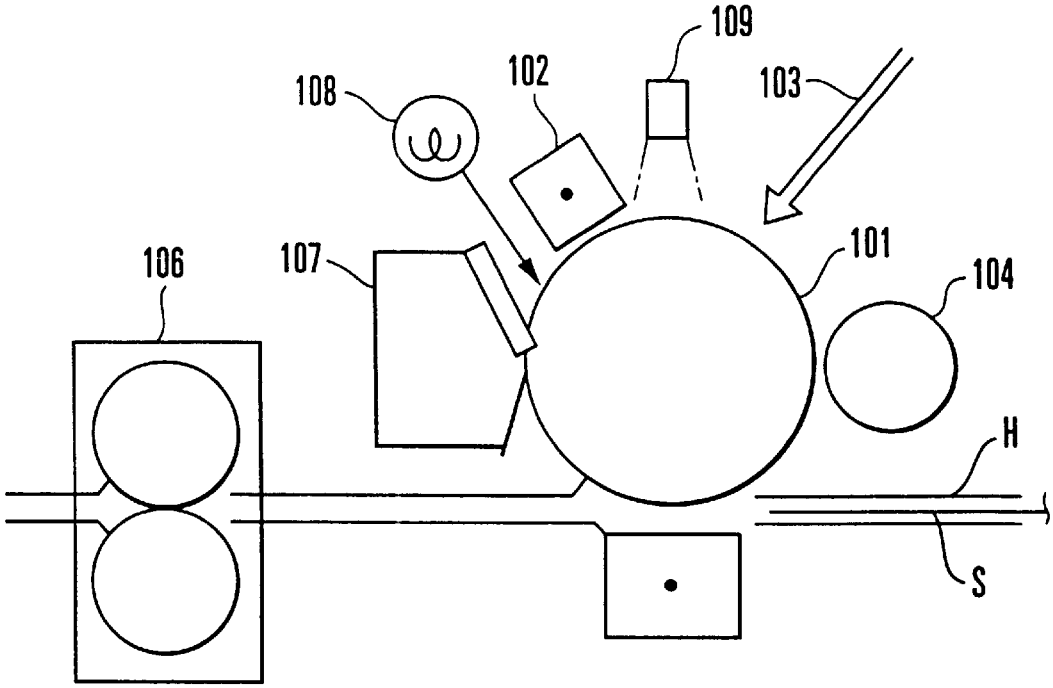
FIG. 7 PRIOR ART
FIG. 7 is a schematic sectional view for explaining the arrangement of essential parts of a conventional image forming apparatus.
Figure 8:
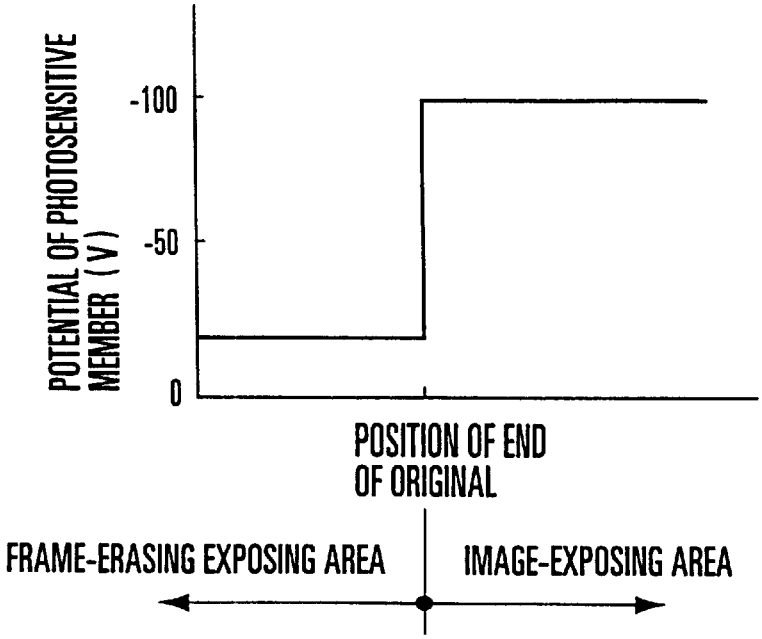
FIG. 8 is a diagram for explaining a change in potential at a border part between the frame-erasing exposing area and the image-exposing area.

Incidentally, although not illustrated in FIG. 1, a conveying path, a transfer means and a cleaning means are disposed around the photosensitive member drum 1, as described in the conventional image forming apparatus referring to FIG. 7. Further, a fixing device is disposed on the downstream side of the conveying path.

Reference numeral 6 denotes optical elements each serving as an amount-of-erasing-charge restricting means for restricting the amount of exposure light on a peripheral part for exposure on the photosensitive member drum 1 (an end part of an exposure area R1 in the rotating direction of the photosensitive member drum 1). In the case of the first embodiment, the optical element 6 is a transparent member having an acute angle and is disposed in such a way as to make a portion of the acute angle face the center of an optical path of the LED array 3.

The optical element 6 may be made of transparent resin such as glass, acryl or polycarbonate, and at least one of the angles of the optical element 6 is formed into an acute angle. Further, the optical element 6 is disposed in such a way as to make a portion of the acute angle face the center of an optical path of the LED array 3. Therefore, light passing through the optical element 6 is attenuated on the upstream side portion and the downstream side portion in the rotating direction of the photosensitive member drum 1. In particular, at an end portion of the optical element 6 having the largest thickness, illuminance is lowered remarkably.

With the optical element 6 arranged as described above, the LED array 3 is controlled to be turned on and turned off. When the LED array 3 is turned on, the amount of light at the downstream side portion in the rotating direction of the photosensitive member drum 1 is small, or the amount of light increases gradually according to the rotation of the photosensitive member drum 1. Accordingly, no abrupt change in potential on the photosensitive member drum 1 takes place, and the potential of the photosensitive member drum 1 moderately changes from the potential for the original-exposing portion (image-exposing area) to the potential for the blank-exposing portion (frame-erasing exposing area).

Further, the turning-off of the LED array 3 is effected when the blank exposure is switched to the image exposure. In order to prevent a black line from appearing due to the drop-down of the amount of light at the time of switching from the blank exposure to the image exposure, front ends portions of the blank exposure and the image exposure may be superposed on each other in some cases.

In particular, in such cases, by lowering the illuminance by the exposure of the LED array 3 on the upstream side in the rotating direction of the photosensitive member drum 1, as in the first embodiment, any drop-down of the potential at the position of superposition of the front end portions of the blank exposure and the image exposure is prevented. Therefore, it is possible to suppress the occurrence of the frame fogging.

With the transmission factor of the optical element 6 appropriately selected, even if the amount of light at the central part of a light flux which is incident on the surface of the photosensitive member drum 1 from the LED array 3 is sufficiently secured taking into consideration the deterioration or the like of each LED of the LED array 3, it is possible to prevent the occurrence of the frame fogging at the position of switching between the image-exposing portion and the blank-exposing portion, and it is possible to form a good-quality image having a white front end thereof secured. Further, it is possible to prevent the failure of separation at the fixing device.

Figure 5:
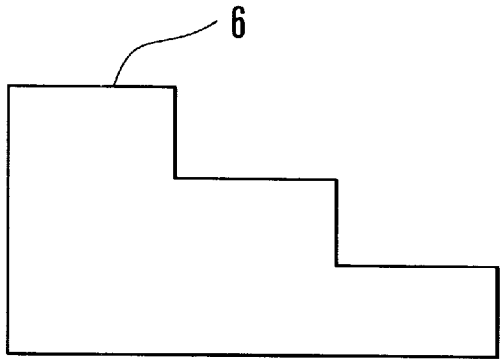
FIG. 5 is a schematic sectional view for explaining an optical element usable in the first embodiment.

Further, in the first embodiment, one angle of the optical element 6 is formed into an acute angle, and the optical element 6 is disposed in such a way as to make a portion of the acute angle face the center of an optical path of the LED array 3. Thus, the amount of light for the frame-erasing exposure which is made incident on the photosensitive member drum 1 is set increasing gradually toward the center of the optical path, and, according to this setting, the surface potential of the photosensitive member drum 1 gradually varies when the LED array 3 is turned on and turned off. However, the optical element 6 may be modified to have such a shape that the thickness thereof varies stepwise as shown in FIG. 5, so that the amount of light at the end portion of the optical path is lowered stepwise, and, accordingly, the surface potential of the photosensitive member drum 1 varies stepwise. In the case of this modification also, the same advantageous effect can be obtained.

Although the above-described arrangement of the optical element 6 is effective regardless of the developing methods, it is particularly effective in a case where the non-contact developing method, which is apt to be effective by the peripheral electric-field effect, is employed.

For example, in a case where the two-component contact developing method, in which the developing electrode effect is strong, is employed, even if the gradient in potential difference between the image-exposing area and the blank-exposing area is large, there is relatively little possibility that the border fogging occurs. On the other hand, in a case where the non-contact developing method, in which the developing electrode effect is weak, is employed, the border fogging is apt to occur due to the peripheral electric-field effect. Since, therefore, it is necessary to make small the gradient in potential difference between the image-exposing area and the blank-exposing area, the arrangement of the optical element 6 in the first embodiment is effective for improvements in the image quality.

In addition, in a case where an alternating electric field is applied to the developing area, particularly, with an electric field of such high frequency as 2000 Hz or more is used, toner particles come into a powder-crowded state within the developing area, so that the developing electrode effect is weakened and the border fogging becomes apt to occur with toner particles gathered by the peripheral electric-field effect. Therefore, it is necessary to make small the gradient in potential difference between the image-exposing area and the blank-exposing area. Thus, the arrangement for making small the gradient in potential difference on the photosensitive member drum 1 by providing the optical element 6 according to the first embodiment is very effective.

The degree of the gradient in potential difference is decided according to the degree to which the developing method as employed is affected by the peripheral electric-field effect. Thus, the characteristics of the optical element 6 may be decided in agreement with the influence of the peripheral electric-field effect.

With the optical element 6 adaptively arranged, in either of a case where the non-contact developing method, in which the developing electrode effect is weak, is used and a case where such a developing method that an alternating electric field is applied to the developing area to bring toner into a powder-crowded state is used, it is possible to supply a good-quality image having no border fogging. This point is particularly advantageous.

Further, if the optical element 6 is arranged to be removably mounted on the image forming apparatus body with a mounting means, it becomes possible to easily clean or exchange the optical element 6 which has become soiled or has deteriorated due to the working operation of the image forming apparatus body. In addition, if the optical element 6 is removed from the image forming apparatus body in a case where the LED array 3 incorporated in the image forming apparatus body has deteriorated due to the endurance limit, with the amount of light emission thereof being lowered, it becomes possible to defer the occurrence of the frame fogging due to the increase of the potential on the photosensitive member drum 1 resulting from the shortage of the amount of light, and it, therefore, becomes possible to prolong the service life of the LED array 3. This point is also advantageous in respect of the saving of resources and the reduction of waste.

Further, it is advantageous that a container portion for temporarily storing the optical element 6 as removed may be provided inside the image forming apparatus body.

(Second Embodiment)

Figure 2:
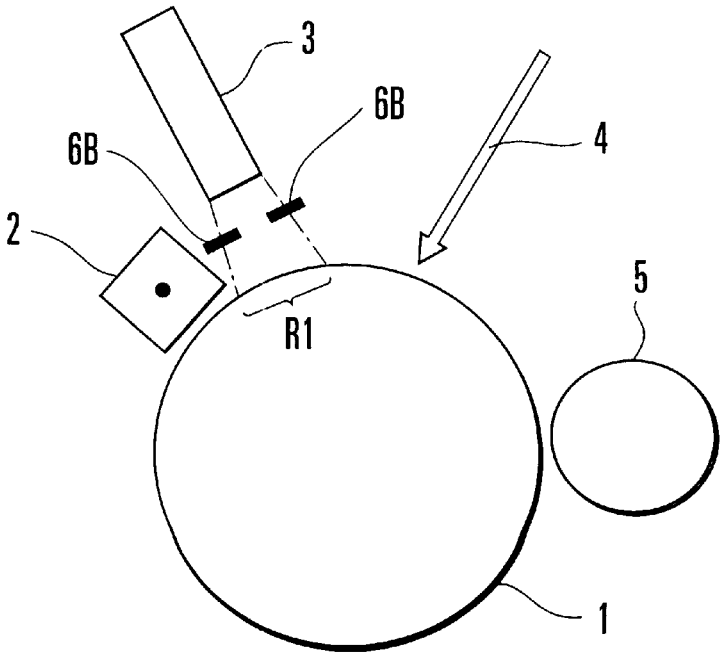
FIG. 2 is a schematic sectional view for explaining the arrangement of essential parts of an image forming apparatus according to a second embodiment of the invention.

FIG. 2 is a schematic sectional view for explaining the arrangement of essential parts of an image forming apparatus according to a second embodiment of the invention. Although, in the first embodiment, a transparent member having the thickness thereof varied is used as the optical element 6, an optical filter is used as the optical element 6B in the second embodiment.

Figure 6:
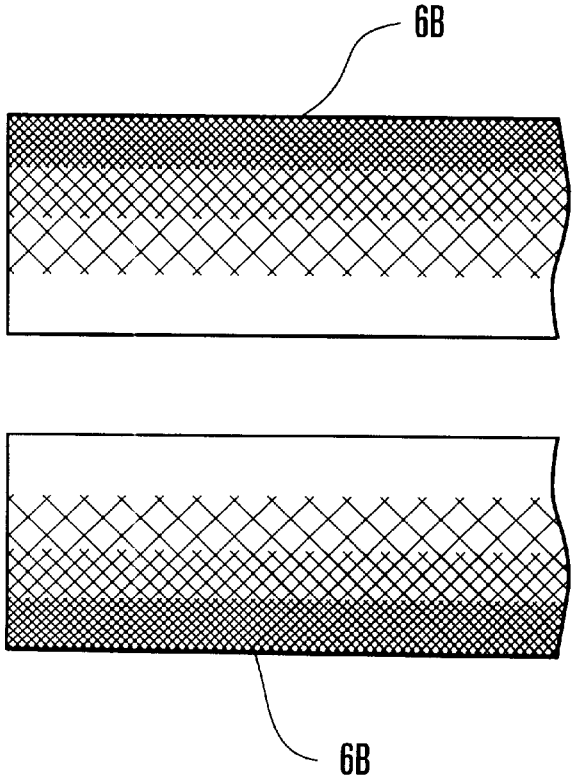
FIG. 6 is a schematic sectional view for explaining an optical element used in the second embodiment.

In the case of the second embodiment, the optical filter 6B is the one in which the amount of light transmission is gradually varied as shown in FIG. 6. More specifically, the optical filter 6B is made such that the light transmission factor on the end portion side of the exposure optical path is set to 50% and the light transmission factor on the center portion side of the exposure optical path is set to 90%. Thus, the amount of light is made to gradually increase from the end portion of the exposure optical path toward the center portion of the exposure optical path.

According to this arrangement, no abrupt change in potential takes place in the vicinity of the switching portion between the blank-exposing portion and the image-exposing portion, and the potential of the photosensitive member drum 1 gradually varies in agreement with the variation of the amount of light. Therefore, it is advantageously possible to prevent the occurrence of the frame fogging or the border fogging.

If an optical filter is used as the optical element 6B, as in the second embodiment, the optical element 6B can be made small as compared with a transparent member made of plastic or the like having the thickness thereof varied. Further, in the case of the optical filter, a variation in light transmission factor can be freely set regardless of space or the like, so that it is possible to easily attain a desired distribution of the amount of light.

(Third Embodiment)

In the above-described first and second embodiments, the potential on the photosensitive member drum 1 is made to vary stepwise or gradually by varying stepwise or gradually the light transmission factor of the optical element 6 or 6B. However, a diffusing filter may be used as the optical element 6 so as to vary the amount of light incident on the surface of the photosensitive member drum 1 without varying the light transmission factor of the optical element 6 itself.

Figure 3:
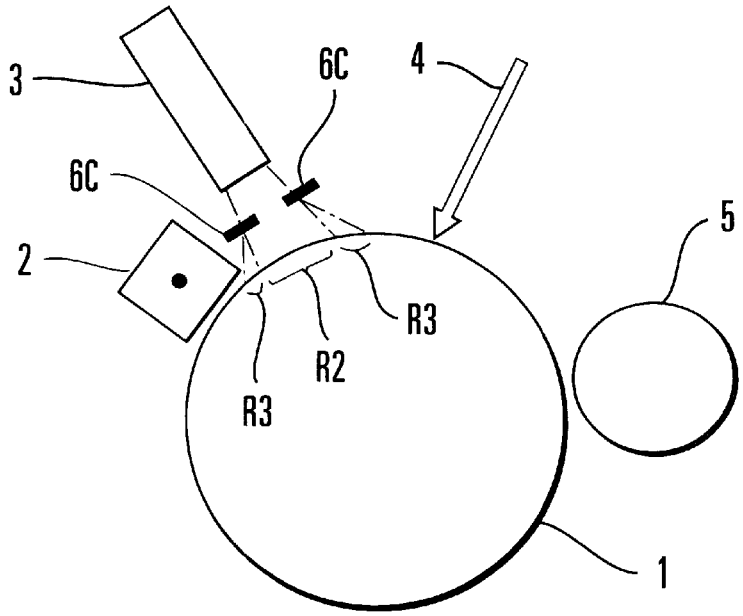
FIG. 3 is a schematic sectional view for explaining the arrangement of essential parts of an image forming apparatus according to a third embodiment of the invention.

FIG. 3 is a schematic sectional view for explaining the arrangement of essential parts of an image forming apparatus according to a third embodiment of the invention. In the third embodiment, a diffusing filter 6C is used as the optical element.

With the diffusing filter 6C used, although an original optical path of the LED array 3 is arranged to illuminate only an area R2 on the surface of the photosensitive member drum 1, the optical path of the LED array 3 is enlarged as much as an area R3, and the amount of light incident on the surface of the photosensitive member drum 1 is made to vary from the end portion of the exposure optical path toward the center portion of the exposure optical path, thereby gradually varying the potential on the photosensitive member drum 1. Therefore, it is possible to prevent the occurrence of the border fogging.

In addition, in order to obtain the same effect as that obtained when the optical element such as the diffusing filter 6C is used, an exposure intensity control means may be provided for gradually varying the intensity of light emission of the LED array 3 at the time of start of exposure or at the time of end of exposure so as to vary the amount of light incident on the surface of the photosensitive member drum 1.

(Fourth Embodiment)

Figure 4:
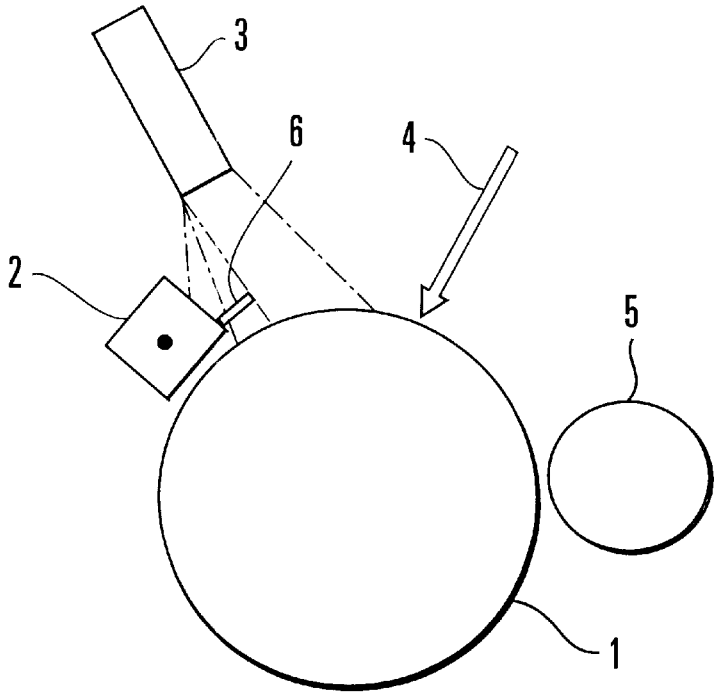
FIG. 4 is a schematic sectional view for explaining the arrangement of essential parts of an image forming apparatus according to a fourth embodiment of the invention.

FIG. 4 is a schematic sectional view for explaining the arrangement of essential parts of an image forming apparatus according to a fourth embodiment of the invention. In the fourth embodiment, it is assumed that the image forming apparatus is a small-sized one in which the photosensitive member drum 1 has a diameter of less than 30 mm. In such a small-sized image forming apparatus, the charger 2 is often arranged to block a part of the optical path of the LED array 3 for reasons of space, thereby determining the border of the blank-exposing optical path.

In this case, a large difference in the amount of light takes place at a portion which is blocked by the charger 2. Therefore, a large contrast in potential is apt to take place on the photosensitive member drum 1, so that the border fogging becomes apt to occur due to the peripheral electric-field effect.

In the case of the above-mentioned small-sized image forming apparatus, the optical element 6 is mounted on the charger 2, so that the blank-exposing optical path can be secured up to just before the charger 2. In addition, in a case where a corona charger or the like is used as the charger 2, a current of air flowing from within the charger 2 to the outside is generated due to the charging wind, thereby restraining scattering toner from the developing means from adhering to the optical element 6. Therefore, it is advantageously possible to mitigate the optical element 6 becoming soiled.

Further, in particular, if the diffusing filter 6C employed in the third embodiment is used as the optical element 6 in the case of the fourth embodiment, a contrast of intense light at the edge portion of the charger 2 is mitigated, so that no strong line appears. Therefore, advantageously, the border fogging becomes more inconspicuous.

(Fifth Embodiment)

Figure 9:
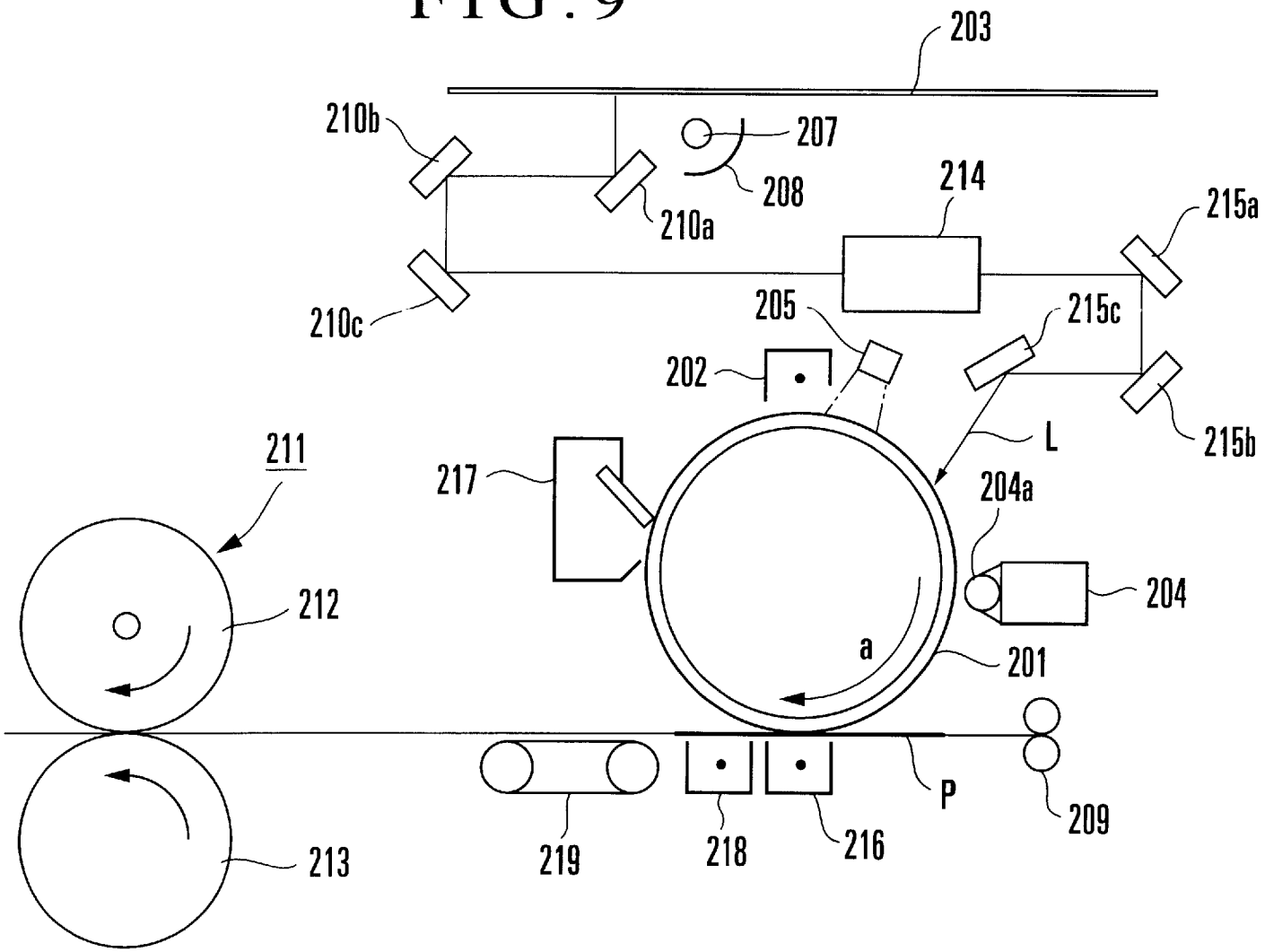
FIG. 9 is a schematic sectional view for explaining the construction of an image forming apparatus according to the invention.
Figure 10:
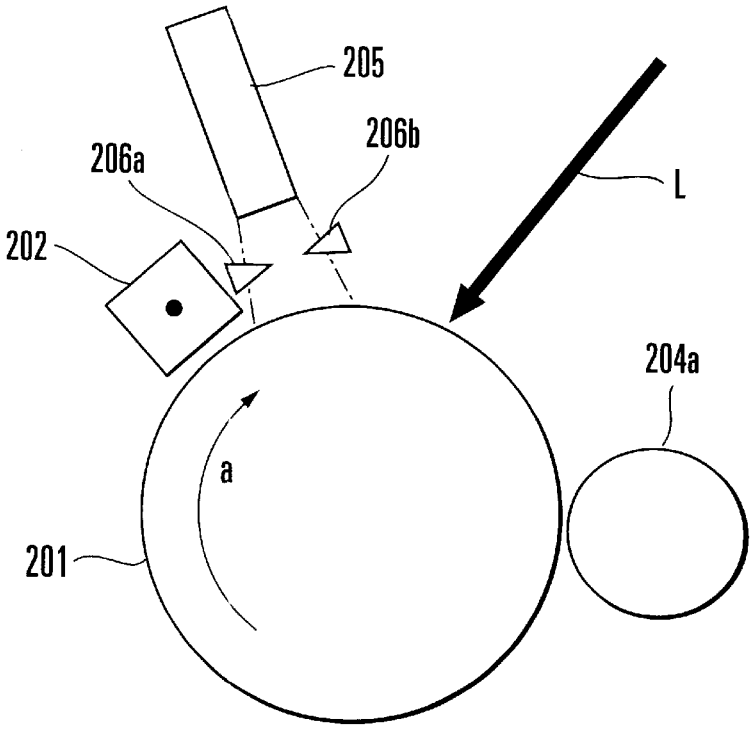
FIG. 10 is a schematic sectional view for explaining the arrangement of essential parts of an image forming apparatus according to a fifth embodiment of the invention.
Figure 11:
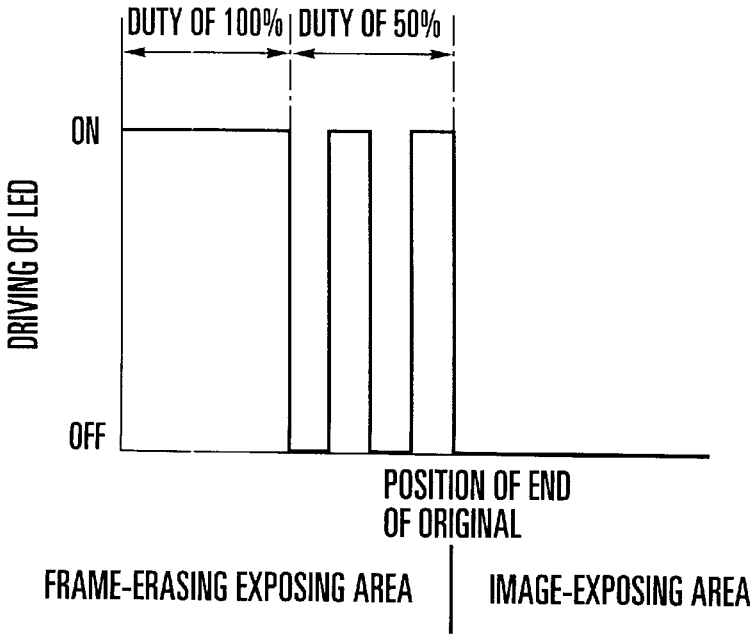
FIG. 11 is a diagram showing the manner of the turning-on-and-off driving of an exposure charge erasing means during switching from the lighting-on thereof to the lighting-off thereof.

FIG. 9 is a schematic sectional view for explaining the construction of an analog copying machine serving as an image forming apparatus according to the invention. FIG. 10 is a schematic sectional view for explaining the arrangement of essential parts of an image forming apparatus according to a fifth embodiment of the invention. FIG. 11 is a diagram showing the manner of the turning-on-and-off driving of an exposure charge erasing means during switching from the lighting-on thereof to the lighting-off thereof.

First, referring to FIGS. 9 and 10, reference numeral 201 denotes an electrophotographic photosensitive member drum having a photosensitive member provided on the outer surface thereof, which serves as an electrostatic latent image bearing member. More specifically, the photosensitive member drum 201 is formed by providing a photoconductive layer made of an organic photosensitive material, α-Si (amorphous silicon), Se (selenium) or the like on a conductive base member made of Al (aluminum), Fe (iron) or the like.

Reference numeral 202 denotes a charging device serving as a charging means for uniformly charging the surface of the photosensitive member drum 201 to the predetermined polarity and to the predetermined potential in the process of rotation of the photosensitive member drum 201 in the direction of an arrow "a" shown in FIGS. 9 and 10. As the charging device 202, a known corona charging device, a roller charging device or the like is used.

An original placed on an original-placing glass board 203 is illuminated by a halogen lamp 207 and a reflector 208. A light image obtained by reflection from the original is made to enter a zoom lens 214 through reflection mirrors 210*a,* 210*b* and 210*c*. Then, the light image is made incident on the surface of the photosensitive member drum 1, which is uniformly charged, through reflection mirrors 215*a,* 215*b* and 215*c,* so that an electrostatic latent image is formed on the surface of the photosensitive member drum 201.

In this instance, the image is reduced, enlarged or equalized in magnification according to the positional relationship between the reflection mirror 210*c* and the zoom lens 214. An image exposure L is scanned on the downstream side of the charging device 202 in the rotating direction of the photosensitive member drum 201 indicated by the arrow "a" in FIGS. 9 and 10.

Reference numeral 204 denotes a developing device serving as a developing means for performing developing by supplying toner, which serves as a developing agent, to the electrostatic latent image formed on the surface of the photosensitive member drum 201. A developing sleeve 204*a,* which is mounted inside the developing device 204 in such a way as to be rotatable, is disposed opposite the photosensitive member drum 201 without coming into contact therewith. The developing operation of the developing device 204 is performed such that, with an alternating electric field applied to a developing area of the photosensitive member drum 201, toner is caused by the inverting developing to adhere, in a thin layer form, to the electrostatic latent image formed on the surface of the photosensitive member drum 201, thereby forming a toner image as a visible image. The developing sleeve 204*a* is disposed on the downstream side of the image exposing position at which the image exposure L is scanned, in the rotating direction of the photosensitive member drum 201 indicated by the arrow "a" in FIGS. 9 and 10.

The electrostatic latent image formed on the surface of the photosensitive member drum 201 is made to reach the position of the developing device 204 in accordance with the rotation of the photosensitive member drum 201, and is developed with toner supplied from the developing device 204 so as to be converted into a visible image as a toner image. The toner image thus formed on the surface of the photosensitive member drum 201 advances to a transfer portion at which a transfer charger 216 is disposed, in accordance with the rotation of the photosensitive member drum 201.

On the other hand, a sheet P which serves as a transfer member made of paper, plastic or the like and is separated and fed one by one by a feed means (not shown) is corrected for oblique travel by a pair of registration rollers 209 and is then conveyed to a portion between the photosensitive member drum 201 and the transfer charger 216 disposed opposite to the photosensitive member drum 201, in synchronism with the rotation of the photosensitive member drum 201, which serves as an image forming means.

Then, the sheet P, which has been conveyed by the pair of registration rollers 209 in synchronism with the rotation of the photosensitive member drum 201, is led to the transfer portion between the photosensitive member drum 201 and the transfer charger 216. At the transfer portion, the sheet P is caused to come into tight contact with the surface of the photosensitive member drum 201.

Then, at this transfer portion, electric charges opposite in polarity to the toner image are applied to the back side of the sheet P by the transfer charger 216, so that the toner image on the photosensitive member drum 201 is shifted, attracted and transferred onto the sheet P by electrostatic force.

A separation charger 218 is disposed on the downstream side of the transfer charger 216 in the conveying direction of the sheet P. The sheet P having the toner image transferred thereto is deprived of electric charges by corona discharge by the separation charger 218, thereby losing an attractive force to the photosensitive member drum 201. Therefore, the sheet P is separated from the photosensitive member drum 201 due to the elasticity of the sheet P and its own weight.

The sheet P, which has been separated from the photosensitive member drum 201, is transported to a fixing device 211 by a conveying belt 219. The fixing device 211 is composed of a fixing roller 212 serving as a fixing rotary member with which the surface of the sheet P having the unfixed toner image formed thereon comes into tight contact, and a pressure roller 213 serving as a pressure rotary member disposed opposite to the fixing roller 212. When passing through the nip portion between the fixing roller 212 and the pressure roller 213, the sheet P is heated and pressed, and is then delivered to the outside of the image forming apparatus.

Reference numeral 217 denotes a cleaner serving as a cleaning means. The cleaner 217 is disposed on the upstream side of the charging device 202 in the rotating direction of the photosensitive member drum 201 indicated by the arrow "a" in FIG. 9. After the sheet P having the toner image transferred thereto is separated from the photosensitive member drum 201, the surface of the photosensitive member drum 201 is cleaned by the cleaner 217 with any adhering residual pollutant, such as residual toner, removed. Then, the photosensitive member drum 201 is used for the next image forming step.

Incidentally, the image exposure L may be an analog exposure using reflection light from the surface of the original or may be a digital exposure using a laser or an LED (light emitting diode).

Reference numeral 205 denotes an LED array serving as an exposure charge erasing means for exposing the photosensitive member drum 201 to erase electric charges on an unnecessary part thereof. The LED array 205 is driven by a driving circuit (not shown) to be turned on and turned off in such a way as to erase the dark potential outside the original-image-exposing area. As a driving power supply for the LED array 205, a constant current power supply is ordinarily used for stabilizing the amount of light emission.

A frame-erasing exposure emitted from the LED array 205 is made incident on a portion on the downstream side of the charging device 202 and on the upstream side of the position of the image exposure L incident on the surface of the photosensitive member drum 201 in the rotating direction of the photosensitive member drum 201 indicated by the arrows "a" in FIGS. 9 and 10.

Optical elements 206*a* and 206*b* are disposed on an optical path leading from the LED array 205 to the surface of the photosensitive member drum 201. The optical elements 206*a* and 206*b* are arranged to vary the amount of light incident on the surface of the photosensitive member drum 201 from the LED array 205 when the LED array 205 is turned on or turned off, thereby varying continuously (gradually) or stepwise the potential of the surface of the photosensitive member drum 201. In the fifth embodiment, each of the optical elements 206*a* and 206*b* is a transparent member having a predetermined refractive index and formed in a prism shape composed of an isosceles triangle in section as shown in FIG. 10 (one angle thereof being an acute angle), and is disposed such that the acute angle portion thereof faces the center of the optical path of the LED array 205.

Each of the optical elements 206*a* and 206*b* may be made of transparent resin such as glass, acryl or polycarbonate, and at least one of the angles of each of the optical elements 206*a* and 206*b* is formed into an acute angle. Further, each of the optical elements 206*a* and 206*b* is disposed in such a way as to make a portion of the acute angle face the center of the optical path of the LED array 205. Therefore, light passing through each of the optical elements 206*a* and 206*b* is continuously (gradually) attenuated on the upstream side portion and the downstream side portion in the rotating direction of the photosensitive member drum 201 indicated by the arrow "a" in FIGS. 9 and 10. In particular, at an end portion of each of the optical elements 206*a* and 206*b* having the largest thickness, illuminance (the amount of light) is lowered remarkably.

With each of the optical elements 206*a* and 206*b* arranged as described above, the LED array 205 is controlled to be turned on and turned off. when the LED array 205 is turned on, the amount of light at the downstream portion in the rotating direction of the photosensitive member drum 201 on the optical path of the LED array 205 is small, or the amount of light increases gradually according to the rotation of the photosensitive member drum 201. Accordingly, no abrupt change in the potential on the photosensitive member drum 201 takes place, and the potential of the photosensitive member drum 201 moderately changes from the potential for the original-image-exposing portion (image-exposing area) to the potential for the blank-exposing portion (frame-erasing exposing area).

Further, the turning-off of the LED array 205 is effected when the blank exposure is switched to the image exposure. In order to prevent the frame fogging (black line) from appearing due to the drop-down of the amount of light at the time of switching from the blank exposure to the image exposure, front ends portions of the blank exposure (frame-erasing exposure) and the image exposure (original-image exposure) may be superposed on each other in some cases.

In particular, in such cases, by lowering the illuminance (the amount of light) by the exposure of the LED array 205 on the upstream side in the rotating direction of the photosensitive member drum 201, as in the fifth embodiment, any drop-down of the potential at the position of superposition of the front end portions of the blank exposure and the image exposure is prevented. Therefore, it is possible to suppress the occurrence of the frame fogging.

With the transmission factor of each of the optical elements 206*a* and 206*b* appropriately selected, even if the amount of light at the central part of a light flux which is incident on the surface of the photosensitive member drum 201 from the LED array 205 is sufficiently secured taking into consideration the deterioration or the like of each Led of the LED array 205, it is possible to prevent the occurrence of the frame fogging at the position of switching between the image-exposing portion and the blank-exposing portion, and it is possible to form a good-quality image having a white front end thereof secured. Further, it is possible to prevent the failure of separation at the fixing device 211.

With the above construction, the arrangement for making the LED array 205 have a variation of the amount of light is very effective. Thus, according to the fifth embodiment, as shown in FIG. 11, when the LED array 205 is switched from the turning-on to the turning-off, the LED array 205 is arranged to become turned off from the turning-on at a light emitting duty of 100% via the turning-on at a light emitting duty of 50%.

The variation of the light emitting duty at the time of switching from the turning-on to the turning-off of the LED array 205 is determined on the basis of the various conditions, such as a variety of kinds of constituent conditions, the rotation speed of the photosensitive member drum 201, the photosensitivity of the photosensitive member drum 201, etc. For example, the light emitting duty is varied by gradually shortening the turning-on time of the LED array 205 in such a manner that the continuous turning-on, the turning-off for 6 msec, the turning-on for 4 msec, the turning-off for 4 msec, the turning-on for 2 msec and the continuous turning-off occur in that order. With the potential of the surface of the photosensitive member drum 201 continuously (gradually) or stepwise varied as mentioned above, it is possible to form a good-quality image having no frame fogging.

Further, although, in FIG. 11, an example in which the light emitting duty is varied at the time of switching from the turning-on to the turning-off of the LED array 205 has been described, the same advantageous effect can be also obtained even if the light emitting duty of the LED array 205 is varied at the time of switching from the turning-off to the turning-on of the LED array 205.

According to the above-described arrangement, the optical elements 206*a* and 206*b* disposed on the optical path leading from the LED array 205 to the photosensitive member drum 201 cause the amount of light incident on the photosensitive member drum 201 from the LED array 205 to vary at the time of the turning-on and/or the turning-off of the LED array 205, thereby varying continuously (gradually) or stepwise the potential of the photosensitive member drum 201. Accordingly, a contrast in potential occurring at the border between the frame-erasing exposing area and the original-image-exposing area is mitigated, so that it is possible to prevent the occurrence of the frame fogging or the border fogging.

Further, by varying the light emitting duty of the LED array 205 at the time of the turning-on and/or the turning-off of the LED array 205, a contrast in potential occurring at the border between the frame-erasing exposing area and the original-image-exposing area is more effectively mitigated, so that it is also possible to prevent the occurrence of the frame fogging or the border fogging.

Further, the above-described arrangement is effective even in the case of the non-contact developing method in which the developing sleeve 204*a* of the developing device 204 serving as a developing means does not come into contact with the photosensitive member drum 201, as in the fifth embodiment, and the developing electrode effect is small. In this case also, by mitigating a contrast in potential occurring at the border between the frame-erasing exposing area and the original-image-exposing area, it is possible to prevent the occurrence of the frame fogging or the border fogging.

Furthermore, the above-described arrangement is effective even in a case where the developing means performs developing by applying an alternating electric field to the developing area to bring at least a part of the developing agent into a powder-crowded state, as in the fifth embodiment, and the developing electrode effect is small. In this case also, by mitigating a contrast in potential occurring at the border between the frame-erasing exposing area and the original-image-exposing area, it is possible to prevent the occurrence of the frame fogging or the border fogging.

Although the above-described arrangement for disposing the optical elements 206*a* and 206*b* between the LED array 205 and the photosensitive member drum 201 is effective in a variety of developing methods, it is particularly effective in a case where a developing method which is apt to be affected by the peripheral electric-field effect is employed. For example, in a case where the two-component contact developing method, in which the developing electrode effect is strong, is employed, even if the gradient in potential difference between the original-image-exposing area and the frame-erasing exposing area (blank-exposing area) is large, there is relatively little possibility that the border fogging occurs. On the other hand, in a case where the non-contact developing method, in which the developing electrode effect is weak, is employed, the border fogging is apt to occur due to the peripheral electric-field effect. Therefore, it is necessary to make small the gradient in potential difference between the original-image-exposing area and the frame-erasing exposing area (blank-exposing area).

In addition, in a case where an alternating electric field is applied to the developing area, particularly, with an electric field of such high frequency as 2000 Hz or more used, toner particles come into a powder-crowded state within the developing area, so that the developing electrode effect is weakened and the border fogging becomes apt to occur with toner particles gathered by the peripheral electric-field effect. Therefore, it is necessary to make small the gradient in potential difference between the original-image-exposing area and the frame-erasing exposing area (blank-exposing area).

Thus, as described in the foregoing, the optical elements 206*a* and 206*b* are disposed between the LED array 205 and the photosensitive member drum 201, and the light emitting duty of the LED array 205 is varied at the time of the turning-on or the turning-off of the LED array 205, so that the gradient in potential on the surface of the photosensitive member drum 201 can be made small. Accordingly, in either of a case where the non-contact developing method, in which the developing electrode effect is weak, is employed and a case where such a developing method that an alternating electric field is applied to the developing area to bring toner into a powder-crowded state is employed, it is possible to supply a good-quality image having no border fogging.

The degree to which the gradient in potential at the position of switching between the original-image-exposing area and the frame-erasing exposing area (blank-exposing area) is to be set may be decided according to the degree to which the developing method as employed is affected by the peripheral electric-field effect. Thus, the characteristics of the optical elements 206*a* and 206*b* and the variation of the light emitting duty of the LED array 205 may be decided in agreement with the influence of the peripheral electric-field effect.

Further, if the optical elements 206*a* and 206*b* are arranged to be removably mounted on the image forming apparatus body, it becomes possible to easily clean or exchange the optical elements 206*a* and 206*b* which has become soiled or has deteriorated due to the working operation of the image forming apparatus body.

In addition, if the optical elements 206*a* and 206*b* are removed from the image forming apparatus body in a case where the LED array 205 incorporated in the image forming apparatus body has deteriorated due to the endurance limit, with the amount of light emission thereof being lowered, it becomes possible to defer the occurrence of the frame fogging due to the increase of the potential on the surface of the photosensitive member drum 201 resulting from the shortage of the amount of light, and it, therefore, becomes possible to prolong the service life of the LED array 205. This point is also advantageous in respect of the saving of resources and the reduction of waste.

Further, it is advantageous that a container portion for temporarily storing the optical elements 206*a* and 206*b* as removed may be provided inside the image forming apparatus body.

(Sixth Embodiment)

Figure 12:
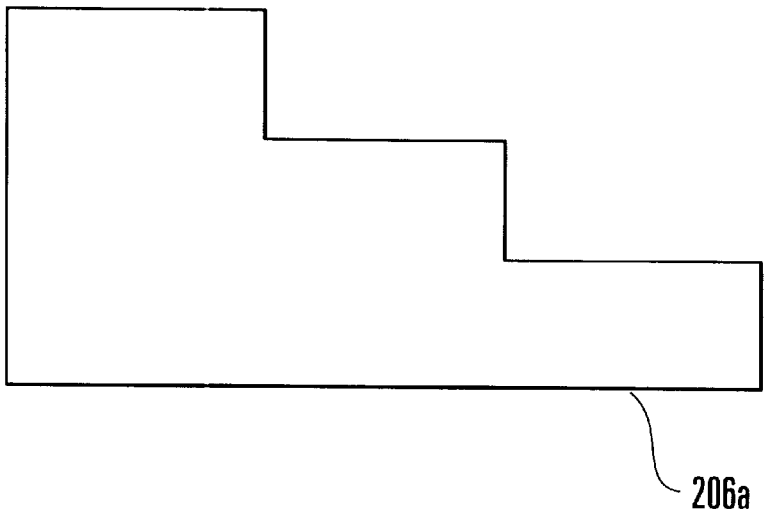
FIG. 12 is a schematic sectional view showing the shape of an optical element used in an image forming apparatus according to a sixth embodiment of the invention.

Next, an image forming apparatus according to a sixth embodiment of the invention is described with reference to FIG. 12. FIG. 12 is a schematic sectional view showing the shape of an optical element used in the image forming apparatus according to the sixth embodiment. In FIG. 12, reference numeral 206*a* denotes one of optical elements similar to the optical elements 206*a* and 206*b* used in the above-described fifth embodiment.

In the above-described fifth embodiment, the optical elements 206*a* and 206*b* are disposed such that a portion of the acute angle of each of the optical elements 206*a* and 206*b* faces the center of an optical path of the LED array 205. Thus, the amount of light for the frame-erasing exposure which is made incident on the photosensitive member drum 201 is set increasing continuously (gradually) toward the center of the optical path of the LED array 205, and, according to this setting, the potential on the surface of the photosensitive member drum 201 continuously (gradually) varies when the LED array 205 is turned on or turned off. According to the sixth embodiment, the optical elements 206*a* and 206*b* may be modified to have such a shape that the thickness thereof varies stepwise as shown in FIG. 12, so that the amount of light at the end portion of the optical path of the LED array 205 is lowered stepwise, and, accordingly, the potential on the surface of the photosensitive member drum 201 varies stepwise when the LED array 205 is turned on or turned off.

It is to be noted that although one optical element 206*a* alone is illustrated in FIG. 12, the other optical element 206*b* may be formed into the shape symmetrical to that of the optical element 206*a* and disposed symmetrically as shown in FIG. 10.

In a case where only the optical elements 206*a* and 206*b* in the sixth embodiment are used to make the amount of light from the LED array 205 have a variation so as to make the potential on the surface of the photosensitive member drum 201 have a gentle variation, it is necessary to enlarge the length (width) of each of the optical elements 206*a* and 206*b* in the rotating direction of the photosensitive member drum 201, so that the size of the image forming apparatus is required to increase.

To prevent such an increase of the size of the image forming apparatus, the arrangement for varying the amount of light by varying the light emitting duty of the LED array 205 at the time of the turning-on or the turning-off of the LED array 205, as in the fifth embodiment, is more effective, making it possible to keep small the length (width) of each of the optical elements 206*a* and 206*b* in the rotating direction of the photosensitive member drum 201, and thereby attaining the small-sized image forming apparatus. The other constituent components in the sixth embodiment are arranged in the same manner as in the fifth embodiment, so that the same advantageous effect can be obtained.

(Seventh Embodiment)

Figure 13:
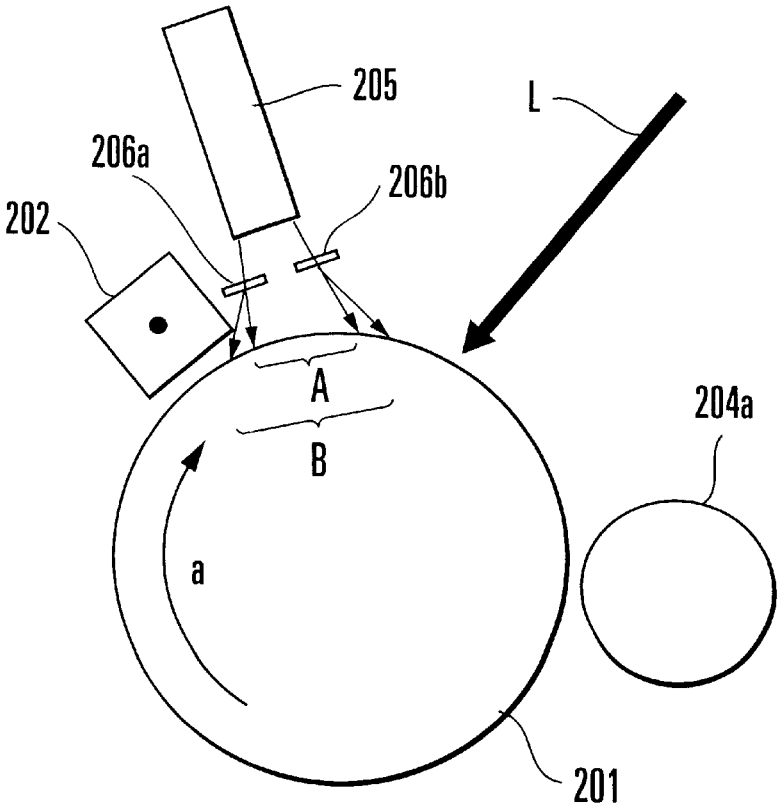
FIG. 13 is a schematic sectional view for explaining the arrangement of essential parts of an image forming apparatus according to a seventh embodiment of the invention.

Next, an image forming apparatus according to a seventh embodiment of the invention is described with reference to FIG. 13. FIG. 13 is a schematic sectional view for explaining the arrangement of essential parts of the image forming apparatus according to the seventh embodiment. In FIG. 13, components similar to those in the fifth embodiment are denoted by the same reference numerals as in FIG. 10, and are, therefore, omitted from the following description.

In the above-described fifth and sixth embodiments, the potential on the surface of the photosensitive member drum 201 is made to vary continuously (gradually) or stepwise by varying continuously (gradually) or stepwise the light transmission factor of each of the optical elements 206*a* and 206*b* . According to the seventh embodiment, a diffusing filter for diffusing light emitted from the LED array 205 is used as each of the optical elements 206*a* and 206*b* so as to vary the amount of light incident on the surface of the photosensitive member drum 201 without varying the light transmission factor of the optical element 206*a* or 206*b* itself.

An original optical path of the LED array 205 is arranged to illuminate only an area A on the surface of the photosensitive member drum 201, as shown in FIG. 13. However, with the diffusing filter used as each of the optical elements 206*a* and 206*b* , the optical path of the LED array 205 for illuminating the surface of the photosensitive member drum 201 is enlarged up to an area B as shown in FIG. 13, and the amount of light incident on the surface of the photosensitive member drum 1 is made to vary from the end portion of the optical path toward the center portion of the optical path. Further, the light emitting duty of the LED array 205 is also varied when the LED array 205 is turned on or turned off. Accordingly, the potential on the surface of the photosensitive member drum 201 can be continuously (gradually) or stepwise varied, so that it is possible to prevent the occurrence of the frame fogging or the border fogging.

Although the diffusing filter used for the optical elements 206*a* and 206*b* may be made of any kind of material or may be formed into any shape according to the various conditions, a diffusing filter having a large haze factor, which is a ratio of transmission factors of diffused light, is highly effective. For example, such a diffusing filter is desirable that the transmission factor of all light rays is within the range of 50% to 95% and the haze factor, which is a ratio of transmission factors of diffused light, is within the range of 70% to 85%.

With each of the optical elements 206*a* and 206*b* composed of a diffusing filter for diffusing light, a contrast in potential occurring at the border between the frame-erasing exposing area and the original-image-exposing area is effectively mitigated by the attenuation effect for the amount of transmitted light and the diffusing action of the diffusing filter, so that it is possible to prevent the occurrence of the frame fogging or the border fogging. The other constituent components in the seventh embodiment are arranged in the same manner as in the fifth embodiment, so that the same advantageous effect can be obtained.

(Eighth Embodiment)

Figure 14:
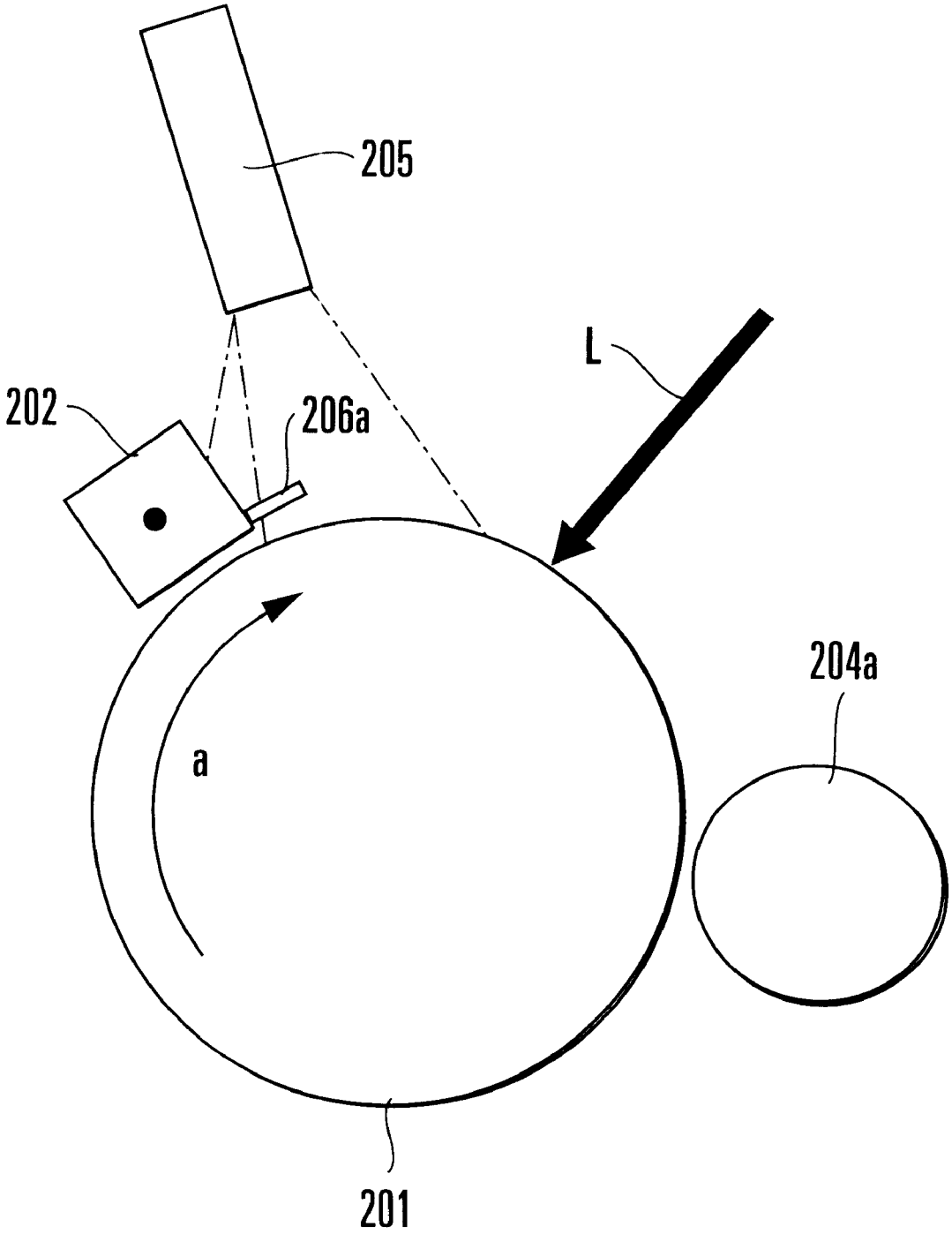
FIG. 14 is a schematic sectional view for explaining the arrangement of essential parts of an image forming apparatus according to an eighth embodiment of the invention.

Next, an image forming apparatus according to an eighth embodiment of the invention is described with reference to FIG. 14. FIG. 14 is a schematic sectional view for explaining the arrangement of essential parts of the image forming apparatus according to the eighth embodiment. In FIG. 14, components similar to those in the fifth embodiment are denoted by the same reference numerals as in FIG. 10, and are, therefore, omitted from the following description.

In a small-sized image forming apparatus having such a construction that the photosensitive member drum 201 has a diameter of less than 30 mm and the charging device 202 is arranged to block a part of the optical path of the LED array 205 for reasons of space, as shown in FIG. 14, the optical path for the frame-erasing exposure (blank exposure) is restricted.

In this case, a large difference in the amount of light takes place at a portion which is blocked by the edge portion of the charging device 202. Therefore, a large contrast in potential is apt to take place on the surface of the photosensitive member drum 201, so that the border fogging becomes apt to occur due to the peripheral electric-field effect.

In a case where, as described above, the optical path for the frame-erasing exposure (blank exposure) is blocked by the edge portion of the charging device 202 so that a large difference in the amount of light takes place at the time of the turning-off of the LED array 205, only the arrangement of the optical elements 206*a* and 206*b* for varying continuously (gradually) or stepwise the amount of light and the variation of the light emitting duty at the time of switching between the turning-on and the turning-off of the LED array 205 are insufficient for completely compensating for the difference in the amount of light at the edge portion of the charging device 202. Although, in such a case, it is possible to remove the frame fogging, it is impossible to completely eliminate the border fogging, particularly, when the non-contact developing method, in which the developing electrode effect is weak, is employed.

In the case of such a small-sized image forming apparatus having the non-contact developing method employed, a diffusing filter having the haze factor, which is a ratio of transmission factors of diffused light, of the order of 70% to 85% is used as the optical element 206*a* , and this optical element 206*a* is mounted on the charging device 202 in such a way as to be intruded into the optical path of the LED array 205 as much as 3 mm to 5 mm.

In the above-described arrangement, the optical path for the frame-erasing exposure (blank exposure) can be secured up to just before the charging device 202, and the light emitting duty of the LED array 205 is continuously (gradually) lowered from the time of the turning-on to the time of the turning-off of the LED array 205. Accordingly, a large contrast in light occurring at the edge portion of the charging device 202 is mitigated by the light-diffusing effect of the diffusing filter and the substantial change of the amount of light resulting from the turning-on-and-off of the LED array 205, so that it is possible to prevent the occurrence of the frame fogging or the border fogging.

In addition, if the width of the optical element 206*a* protruding into the optical path of the LED array 205 is kept minimum, an optical path for giving sufficient frame-erasing exposure can be secured. Accordingly, it becomes possible to use the LED array 205 with a little loss in the amount of light, so that an increase in temperature of the image forming apparatus body can be suppressed and the service life of the LED array 205 can be prolonged. The other constituent components in the eighth embodiment are arranged in the same manner as in the fifth embodiment, so that the same advantageous effect can be obtained.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. An image forming apparatus, comprising:

a photosensitive member;

a charging means for charging said photosensitive member;

an image exposure means for image-exposing said photosensitive member; and an electric charge erasing means for erasing an electric charge outside an image-exposing area of said photosensitive member, wherein said electric charge erasing means includes a light emitting element and an amount-of-light restricting member for lowering the amount of light which is incident on a border between the image-exposing area and an outside area thereof from said light emitting element throughout, along a longitudinal direction of said photosensitive member.

2. An image forming apparatus according to claim 1, wherein said amount-of-light restricting member has such a property that a degree of amount-of-light restriction becomes smaller in a position farther from the border.

3. An image forming apparatus according to claim 2, wherein said amount-of-light restricting member is a light-transmitting element having an approximate triangle in section.

4. An image forming apparatus according to claim 2, wherein said amount-of-light restricting member is a filter having such a property that a light transmission factor becomes larger in a position farther from the border.

5. An image forming apparatus according to claim 2, wherein said amount-of-light restricting member is a light-diffusing filter.

6. An image forming apparatus according to claim 1, wherein said amount-of-light restricting member is mounted on said charging means.

7. An image forming apparatus according to claim 1, wherein said amount-of-light restricting member is removably mounted on a body of said image forming apparatus.

8. An image forming apparatus according to claim 1, further comprising a control means for controlling a light emitting duty of said light emitting element.

* * * * *